US005542954A

United States Patent [19]

Schrell et al.

[11] Patent Number: 5,542,954

[45] Date of Patent: Aug. 6, 1996

[54] PRODUCTION OF AMINATED COTTON FIBERS

[75] Inventors: Andreas Schrell, Frankfurt; Werner H. Russ, Flörsheim, both of Germany

[73] Assignee: Hoechst Aktiengesellschaft, Frankfurt am Main, Germany

[21] Appl. No.: 377,438

[22] Filed: Jan. 24, 1995

[30] Foreign Application Priority Data

Jan. 26, 1994 [DE] Germany ..... 44 02 210.7

[51] Int. Cl.[6] ..... D06M 13/35; D06P 3/66

[52] U.S. Cl. ..... 8/532; 8/115.58; 8/115.59; 8/115.65; 8/115.66; 8/181; 8/188; 8/189; 8/196; 8/565; 8/567; 8/568; 8/574; 8/598; 8/602; 8/604; 8/606; 8/918; 8/930

[58] Field of Search ..... 8/588, 602, 532, 8/565, 567, 568, 574, 582, 584, 604, 606, 598, 930, 115.58–115.65, 181, 188, 189, 196

[56] References Cited

FOREIGN PATENT DOCUMENTS 2084585 6/1993 Canada .

0158233 10/1985 European Pat. Off. .

0546476 6/1993 European Pat. Off. .

0601351 6/1994 European Pat. Off. .

OTHER PUBLICATIONS

E. R. Trotman, Dyeing and Chemical Technology of Textile Fibers, pp. 48, 170–172.

*Primary Examiner*—Margaret Einsmann

*Attorney, Agent, or Firm*—Connolly and Hutz

[57] ABSTRACT

A process for the production of aminated cotton fibers by subjecting a raw cotton or cotton-polyester mixture to a modification with a saturated aliphatic compound of 3 to 15 carbon atoms which contains at least one primary, secondary, tertiary, or quaternary amino group and at least one hydrolyzable ester group, in which the saturated radical is straight chain, branched, or cyclic, and may be interrupted by one or more hetero groups and may be substituted by one or more hydroxyl groups. The modification occurs simultaneously with scouring, kiering, or dry mercerizing.

14 Claims, No Drawings

PRODUCTION OF AMINATED COTTON FIBERS

FIELD OF THE INVENTION

The invention relates to a process for producing aminated cotton fibers.

DESCRIPTION OF THE PRIOR ART

European Offenlegungsschrift EP 0 546 476 A1 describes a process for producing a modified fiber material and a process for dyeing the modified fiber material with anionic dyes. The modification of the fiber material is effected by applying an aliphatic or cyclic compound that contains an amino group and an ester group to the material and subjecting it to a thermal treatment. A further possibility is to leave the material in such a solution at elevated temperature for a prolonged period. The material to be modified comprises in either case ready-to-dye, i.e. scoured and bleached, cotton and cotton blend fabric types. This process of subsequently modifying ready-to-dye materials in order that they may then be dyed without salt and alkali proves to be economically and ecologically unsound when all the costs are included.

SUMMARY OF THE INVENTION

There is therefore a great need for a process which integrates the process of modifying cotton into steps which have to be carried out on cotton in any event in order that it may be dyed with reactive dyes, i.e. which can also be carried out on raw unpretreated cotton.

This object is achieved by a process for producing aminated cotton fibers, which comprises subjecting raw cotton or raw cotton-polyester mixtures simultaneously with the scouring, kiering or dry mercerizing to a modification through addition of a saturated aliphatic compound of 3 to 15 carbon atoms which contains at least one primary, secondary, tertiary or quaternary amino group and at least one hydrolyzable ester group and in which the saturated radical(s) is or are straight-chain, branched and/or cyclic and may be interrupted by one or more hetero groups and which may be substituted by one or two or more hydroxyl groups.

Suitable agents for modifying raw cotton fibers are compounds of the formulae (1a), (1b) and (1c):

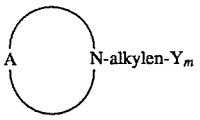

(1a)

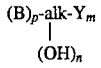

(1b)

$H_2N$-alkylen-$Y_m$ (1c)

where

Y is an ester group;

A and N together with 1 or 2 alkylene groups of I to 4 carbon atoms form the bivalent radical of a heterocyclic ring wherein A is an oxygen atom or a group of the formula (a), (b), or (c)

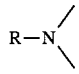

(a)

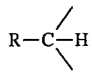

(b)

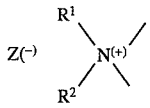

(c)

where

R is a hydrogen atom or an amino group or an alkyl group of 1 to 6 carbon atoms which may be substituted by 1 or 2 substituents selected from the group consisting of amino, sulfo, hydroxyl, sulfato, phosphato and carboxyl, or an alkyl group of 3 to 8 carbon atoms which is interrupted by 1 or 2 groups of the formulae —O— and —NH— or a combination thereof and may be substituted by an amino, sulfo, hydroxyl, sulfato or carboxyl group, $R^1$ is hydrogen, methyl or ethyl, $R^2$ is hydrogen, methyl or ethyl, and $Z^{(-)}$ is an anion;

B is an amino group of the formula $H_2N$— or an amino or ammonium group of the formula (d) or (e)

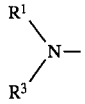

(d)

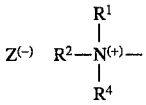

(e)

where $R^1$, $R^2$ and $Z^{(-)}$ are each as defined above, $R^3$ is methyl or ethyl, and $R^4$ is hydrogen, methyl or ethyl;

p is 1 or 2;

alkylen is a straight-chain or branched alkylene radical of 2 to 6 carbon atoms which may be substituted by 1 or 2 hydroxyl groups or is a straight-chain or branched alkylene radical of 3 to 8 carbon atoms which is interrupted by 1 or 2 groups of the formulae —O— and —NH— or a combination thereof;

alk is a straight-chain or branched alkylene radical of 2 to 6 carbon atoms or is a straight-chain or branched alkylene radical of 3 to 8 carbon atoms which is interrupted by 1 or 2 groups of the formulae —O— and —NH— or a combination thereof and is preferably a straight-chain or branched alkylene radical of 2 to 6 carbon atoms;

m is 1 or 2;

n is from 1 to 4;

the amino, hydroxyl and ester groups can be attached to a primary, secondary or tertiary carbon atom of the alkylene radical.

Suitable in many cases are compounds in which the ester group in the amino-containing compound is a sulfato or phosphato group or is a C1–C4-alkanoyloxy group, phenylsulfonyloxy or a phenylsulfonyloxy group substituted in the benzene nucleus by substituents selected from the group consisting of carboxyl, $C_1$–$C_4$-alkyl, $C_1$–$C_4$-alkoxy and nitro.

Examples of compounds which can be used with advantage include N-(β-sulfatoethyl)piperazine, N-[β-(β-sulfatoethoxy) ethyl]piperazine, N-(γ-sulfato-β-hydroxypropyl)-pyrrolidine, N-(β-sulfatoethyl)piperidine, 2-sulfato-3-hydroxy- 1-aminopropane, 3-sulfato-2-hydroxy-1-aminopropane, 1-sulfato-3-hydroxy-2-aminopropane, 3-hydroxy- 1-sulfato-2-aminopropane, 2,3-disulfato-1-aminopropane or 1,3-disulfato-2-aminopropane or a derivative of these compounds with an ester group other than the sulfato group mentioned in the foregoing,in particular N-(2-sulfatoethyl)piperazinesulfate, Also suitable for modifying raw cotton articles are those amino compounds with α-chloro-β-hydroxy substitution as reactive radical on the amine component. It is also possible to use compounds which are capable of reacting with hydroxyl groups, for example of cellulose, or amino and thiol groups, for example of wool and silk, to form a covalent chemical bond.

The modifying during the kiering or scouring of raw cotton articles can take place continuously or batchwise. The kiering or scouring liquid used in batchwise operation is sodium hydroxide solution with about 5 to 30 g/1 of NaOH. The process is preferably carried out in closed vessels at temperatures between 80° C. and 120° C., preferably 90° and 102° C. The pretreatment agent can be added linearly, degressively or directly. The concentrations are between 10 and 100 g/1, preferably 15 to 30 g/1.

The batchwise modifying step of the present invention can follow directly on a bleaching process with hydrogen peroxide by adding the amount of alkali necessary for the pretreatment to the bleaching solution, destroying excess bleaching agent in the process, and then adding the modifying agent. It is advantageous here if no peroxide stabilizer is added to the bleaching solution.

In a continuous process, the amounts of NaOH vary between 5 and 20% by weight, based on weight of fiber, depending on the method of energy supply and the method of liquor application. The apparatus used includes the J-box, roller beds, open width and flash steamer, roller steamers, HT steamers, conveyors, rebatchers and underliquor dwellers. Between 2 and 10% by weight, preferably 3 and 8% by weight, of the modifying agent are used on weight of fiber.

Here too the modifying step of the present invention can be directly adjoined to a continuous bleaching process by padding the prebleached material, which is still very moist, with an alkaline modifying solution of two to three times the strength of a customary liquor and then subjecting the material to a steaming process. The solution for the prebleach should not contain any stabilizers to ensure that padding with the strongly alkaline modifying liquor will rapidly destroy the hydrogen peroxide and so prevent any fiber damage.

The textile fiber material which is used in the pretreatment process of the present invention can be present in any processing state, for instance as yarn, staple, slubbing and piece goods (fabrics).

An essential and surprising advantage of the process of the present invention is that the fiber damage which is a constant feature of scouring or kiering processes is distinctly reduced in the event of a pretreatment with the modifying agents in question.

Also suitable for carrying out the modification are mercerizing processes. The preferred embodiment comprises dry mercerizing by padding the fabric with a 22° to 32° Be., preferably 24° Be., sodium hydroxide solution containing between 30 and 120 g of modifying agent per liter. The material is then dried in a tenter with hot air at 120° C. Washing out leaves a material which shows enhanced luster and can be dyed without salt and alkali according to the present invention.

Another embodiment involves impregnating with a hot liquor of the modifying agent. Following the hot impregnation step, the material passes through a roller mercerization section. In contradistinction to conventional techniques, the temperature during the swelling and in the subsequent stabilizing zone should be maintained for a prolonged period between 80° and 95° C.

The aminated cotton fibers are dyed according to the present invention analogously to known processes for dyeing and printing fiber materials with water-soluble textile dyes using the known temperature ranges and customary dyestuff quantities. The particular advantage here is that the dyebaths, padding processes, print pastes and inkjet formulations require no addition of alkaline compounds as customary for fixing fiber-reactive dyes, nor customary additions of electrolyte salts.

Dyeing processes which can be used according to the present invention include for example the various exhaust processes, such as dyeing on the jigger or on the reel beck or dyeing from long or short liquor, dyeing in jet dyeing machines, dyeing by short-time pad-batch processes or by a pad-superheated steam fixation process. The dyeing processes which can be used according to the present invention also include the printing techniques, including inkier printing and transfer printing.

The dyes which are used for dyeing the aminated cotton fiber are generally anionic in nature. Of particular suitability are the fiber-reactive textile dyes which are capable of reacting with hydroxyl groups, for example cellulose, or amino and thiol groups, for example of wool and silk, of synthetic polymers, such as polyamides, or else modified polymers, precisely the aminated celluloses, to form a covalent bond. Suitable fiber-reactive components on the textile dyes include in particular sulfatoethylsulfonyl, vinylsulfonyl, chlorotriazinyl, fluorotriazinyl, trichloropyrimidyl, difluorochloropyrimidyl, dichloroquinoxalinyl, chloropropylamidyl, α-bromoacrylamidyl and also combinations thereof.

The examples which follow illustrate the process of the present invention. Parts are by weight, unless otherwise stated.

EXAMPLES

Example 1

Cotton twill (predesized, ecru, weight 200 g/kg) is impregnated with an aqueous liquor containing 60 parts of sulfatoethylpiperazine, 100 parts of sodium hydroxide, 5 parts of ®Hostapal FA (tradename of a nonionic wetting and washing agent) and 6 parts of ®Ladit RBO in 1000 parts of water. The wet pickup during this treatment is about 150%. The fabric is then hatched on a roller and left at 95° to 103° C. for 60 minutes. The temperature treatment is followed by a three-fold boil wash, if necessary with a commercial surfactant in the wash liquor, in order that water-soluble impurities present on the fabric may be removed. After rinsing with hot and cold water, the cotton material is dried. The result is a textile fabric with a desizing rating of 9 (evaluation to Tegewa) and a capillary rise of 6.5 cm after 300 minutes, which can be further processed directly in a pad-dyeing process. For this the fabric has applied to it at 25° C. an aqueous dye solution which, per 1000 parts by volume, contains 20 parts of the dye of the formula

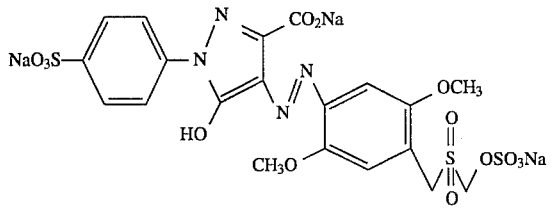

known from European Patent Application 158 233, Ex. 1, and 3 parts of a commercial nonionic wetting agent, by means of a pad-mangle to a wet pickup of 80%, on weight of fiber. The fabric padded with the dye solution is wound onto a batching roller, wrapped in plastic film, left at from 40° to 50° C. for 4 hours and then rinsed with cold and hot water, which may contain a commercial surfactant, and if necessary subsequently once more with cold water, and dried. The result obtained is a strong level yellow dyeing which has good all round fastness properties, especially good rub and light fastness properties.

Example 2

A 50/50 polyester-cotton blend fabric (predesized, ecru, weight 200 g/kg) is impregnated with an aqueous liquor containing 30 parts of sulfatoethylpiperazine, 50 parts of sodium hydroxide and 5 parts of ®Leonil EB (tradename of a nonionic wetting and washing agent) in 1000 parts of water. The wet pickup during this treatment is about 150%. The fabric is then batched on a roller and left at from 95° to 103° C. for 30 minutes. The temperature treatment is followed directly by a multiple boil wash, if necessary with a commercial surfactant in the wash liquors, in order that water-soluble impurities on the fabric may be removed. After rinsing with hot and cold water, the cotton material is dried. 10 parts of this polyester-cotton blend fabric are brought together in an HT apparatus, in a customary exhaust process, in a liquor ratio of 10:1 with a liquor containing 0.1 part of a 50% strength by weight electrolyte-containing C.I. Reactive Red 198

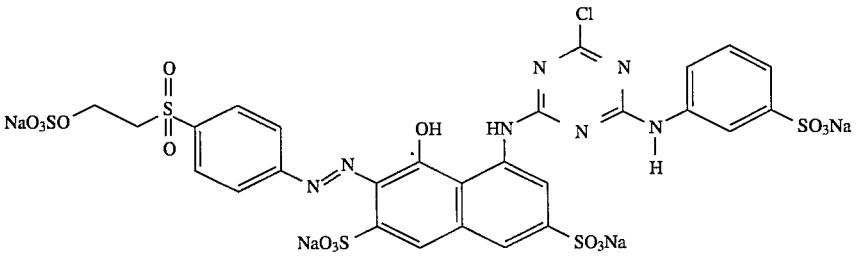

(predominantly sodium chloride-containing) and 0.1 part of a disperse dye

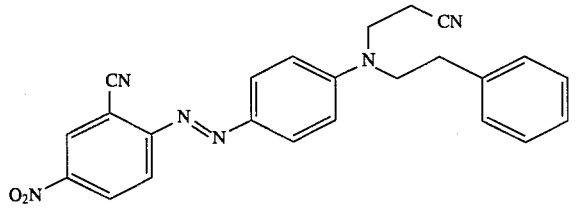

dissolved or dispersed in 100 parts of water. The temperature is raised to 130° C. 30 minutes at this temperature is followed by cooling down, dropping of the colorless liquor, and a conventional wash of the fabric. The result obtained is a strong level red dyeing which in its fastness properties is in all respects up to the standard of a dyeing obtained by the prior art.

Example 3

In an HT apparatus, 150 parts of cotton twill (ecru, weight 200 g/kg) are heated with an aqueous liquor containing 15 parts of sodium hydroxide and 5 parts of Leonil EB (tradename of a nonionic wetting and washing agent) in 750 parts of water to 120° C. At this temperature 30 parts of N-(2-sulfatoethyl)piperazine sulfate, known from EP-A-0 601 351, dissolved in 30 parts of water, are metered in linearly over a period of 30 minutes. On completion of the addition the temperature is left at 120° C. for a further 10 minutes and then the liquor is dropped. The temperature treatment is followed by a three-fold boil wash, if necessary with a commercial surfactant in the wash liquor, in order that water-soluble impurities present on the fabric may be removed. After rinsing with hot and cold water, the cotton material is dried. This leaves a textile fabric having a desizing rating of 9 (evaluation to Tegewa) and a capillary rise of 6.5 cm after 300 minutes, which can be further processed directly in an exhaust dyeing process. The pretreated material, which is still wet, is then admixed with 1000 parts of water in a dyeing apparatus.

The temperature is raised to 60° C. and a total of 2 parts of a 50% strength by weight electrolyte(predominantly sodium chloride)-containing dye powder of the formula, known from DE-A-1943904,

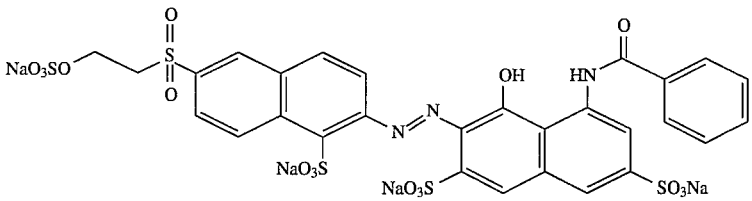

are metered in over a period of 30 minutes. Following a further liquor circulation period of 5 minutes the remaining colorless liquor is dropped and the material is conventionally washed and dried. The result obtained is a strong and deep red dyeing having very good use fastness properties.

Example 4

A cotton twill fabric (ecru, desized, weight 200 g/kg) is impregnated with a 60° C. sodium hydroxide solution of 30° Be. containing 60 g of N-(2-sulfatoethyl)piperazine sulfate per liter and rolled up under pressure and then rolled onto a second roller preheated to 80° C. The transfer from roll to roll, which takes place with the rolls in constant direct contact and at a temperature of 90° C. and thus with shrinkage being prevented, is followed by a tensioning zone. The transfer from roll to roll takes 15 minutes and the residence time in the tensioning zone is 10 minutes. This is followed by a decausticization by spraying with hot water and a boil wash, if necessary with a commercial surfactant in the wash liquor. After acidification and a further rinse with hot and cold water, the cotton material is dried. The result is a textile fabric which, subsequently scoured under known conditions, can be dyed without salt and alkali. For this, 10 parts of this material are transferred into a dyeing apparatus and treated at a liquor ratio of 10:1 with an aqueous liquor which, based on the weight of the dry material, contains 0.1 part of a reactive dye of the formula

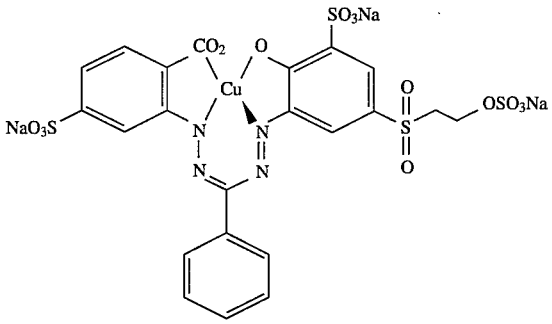

known from EP-A-0 028 788 Ex. 2, in solution. The fiber mixture is dyed at 80° C. for 30 minutes. The further treatment of the dyeing thus created is by rinsing and soaping in the conventional manner. The result obtained is a deep blue dyeing having the very good use fastness properties customary in the prior art.

Example 5

In a continuous process, unbleached cotton interlock is immersed in rope form at 100° C. into a bath containing 1%, based on the amount of liquid, of a 50% strength by weight sodium hydroxide solution and 1%, based on the amount of liquid, of a 35% strength by weight hydrogen peroxide solution. The material is left to dwell for 10 min and then pulled through a pair of squeeze rollers to leave a wet pickup of about 80%. The material is then guided through a wetting trough with multiple squeeze rollers, containing a solution containing 210 g/l of N-(2-sulfatoethyl)piperazine sulfate and 210 ml/l of a 50% strength sodium hydroxide solution. In the course of this process the material is impregnated to a wet pickup of 110%. With further treatment the rope is then passed into a J-box and left therein for 30 minutes at a temperature between 95° and 98° C. This is followed by thorough washing, removing dissolved soil particles and excess alkali from the material, and setting a residual moisture content of 100%. The still moist material can thereafter be directly dyed in a jet dyeing machine by an exhaust method. For this 1000 parts of material have added to them 10,000 parts of water. Then 20 parts of a dye of the formula

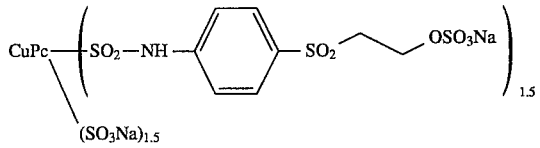

known from DE-A-1 179 317, Example 2, are metered in over a period of 10 minutes. The liquor is heated to 80° C. and the material is left at that temperature for 45 minutes. This is followed by cooling down to 60° C., dropping of the residual liquor, and aftertreating of the material by conventional methods. Drying leaves a strong turquoise dyeing having the customary use fastness properties.

Example 6

To 1000 parts of unbleached cotton jersey in a jet dyeing machine are added 5000 parts of water containing 50 parts of a 35% strength by weight hydrogen peroxide solution and 75 parts of a 50% strength by weight sodium hydroxide solution. The knit is heated to 98° C. at 3° C. per minute and held at 98° C. for 10 min. Thereafter 360 parts of a 50% strength by weight sodium hydroxide solution are added, the temperature is held at above 95° C. to destroy excess hydrogen peroxide solution. Then 760 parts by volume of a solution containing 180 parts of N-(2-sulfatoethyl)piperazine sulfate in solution is added over 10 min and the temperature is held at 98° C for a further 30 minutes. This is followed by cooling down to 60° C., washing alkali-free and aftertreating the material with acetic acid. The knit so prebleached and modified can thereafter be directly dyed without any additions. For this the directions of Example 5 are followed.

Further examples:

Example 1 is repeated using the following dyes. The results obtained are similar.

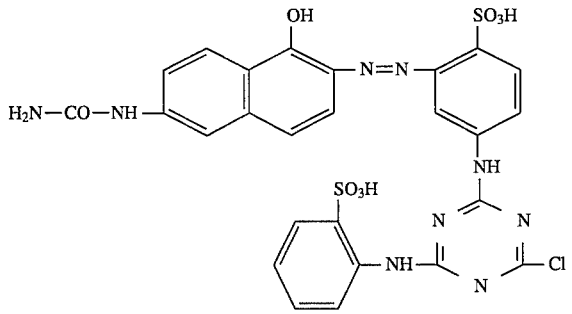
orange
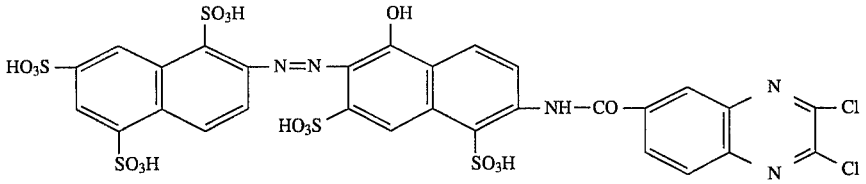
orange
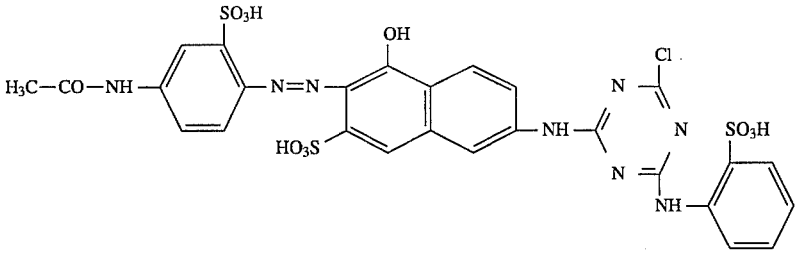
scarlet
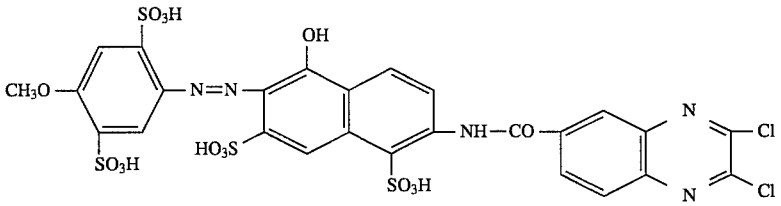
scarlet
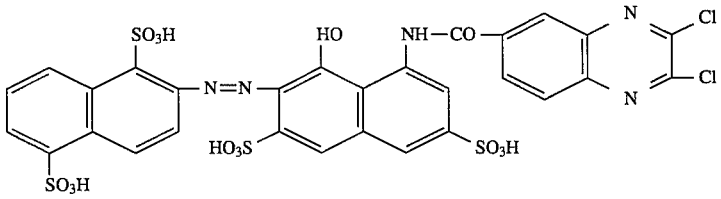
red
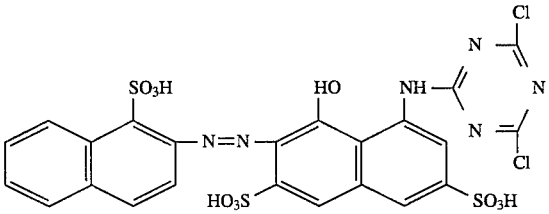
red
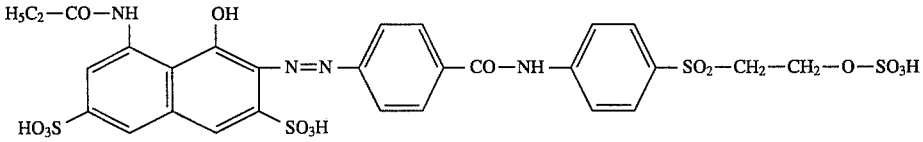
red -continued turquoise

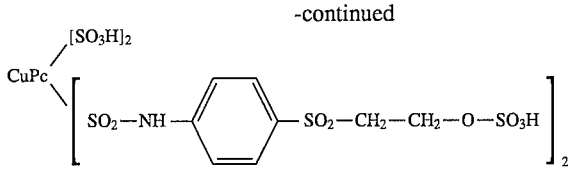

CuPc = copper phthalocyanine

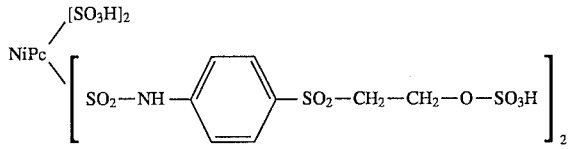

NiPc = nickel phthalocyanine dark blue

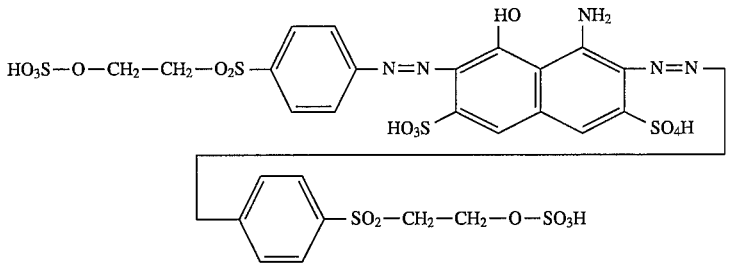

anthracite

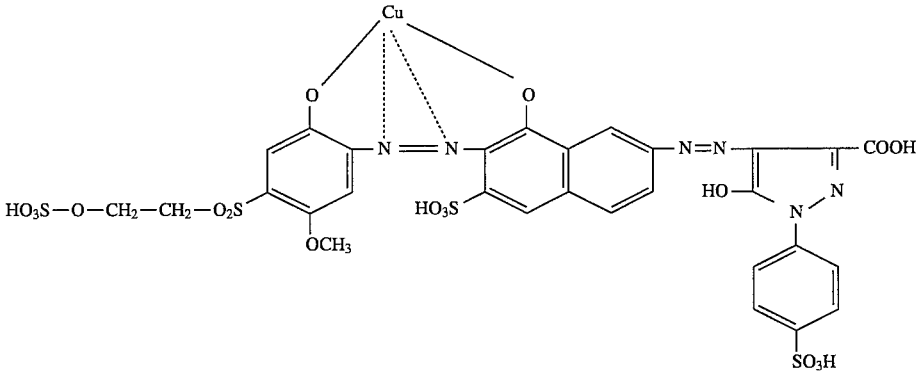

red

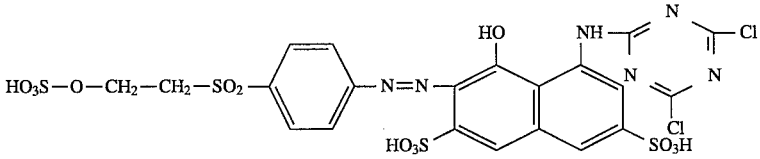

What is claimed is:

1. A process for the production of aminated cotton fibers, which comprises the steps of:

subjecting raw cotton or a mixture of raw cotton and polyester to a modification conducted simultaneously with scouring or kiering, wherein the modification comprises the addition of a saturated aliphatic compound of 3 to 15 carbon atoms which contains at least one primary, secondary, tertiary, or quaternary amino group and at least one hydrolyzable ester group and in which the saturated radical or radicals are straight-chain, branched or cyclic, or branched and cyclic and are optionally interrupted by one or more hetero groups and which are optionally substituted by one or more hydroxyl groups.

2. The process of claim 1, wherein the modifying agent is a compound of the formula (1a), (1b) or (1c)

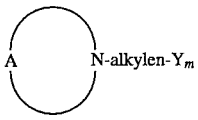

(1a)

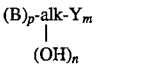

(1b)

$H_2N$-alkylen-$Y_m$ (1c)

where

Y is an ester group;

A and N together with 1 or 2 alkylene groups of 1 to 4 carbon atoms form the bivalent radical of a heterocyclic ring wherein A is an oxygen atom or a group of the formula (a), (b), or (c)

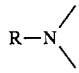

(a)

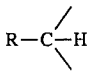

(b)

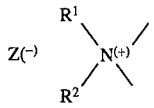

(c)

where

R is a hydrogen atom or an amino group or an alkyl group of 1 to 6 carbon atoms which is optionally substituted by 1 or 2 substituents selected from the group consisting of amino, sulfo, hydroxyl, sulfato, phosphato and carboxyl, or an alkyl group of 3 to 8 carbon atoms which is interrupted by 1 or 2 groups of the formulae —O— and —NH— or a combination thereof and is optionally substituted by an amino, sulfo, hydroxyl, sulfato or carboxyl group, $R^1$ is hydrogen, methyl or ethyl, $R^2$ is hydrogen, methyl or ethyl, and $Z^{(-)}$ is an anion;

B is an amino group of the formula $H_2N$— or an amino or ammonium group of the formula (d) or (e)

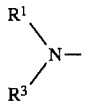

(d)

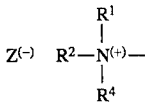

(e)

where $R^1$, $R^2$ and $Z^{(-)}$ are each as defined above, $R^3$ is methyl or ethyl, and $R^4$ is hydrogen, methyl or ethyl;

p is 1 or 2;

alkylen is a straight-chain or branched alkylene radical of 2 to 6 carbon atoms which is optionally substituted by 1 or 2 hydroxyl groups or is a straight-chain or branched alkylene radical of 3 to 8 carbon atoms which is interrupted by 1 or 2 groups of the formulae —O— and —NH— or a combination thereof;

alk is a straight-chain or branched alkylene radical of 2 to 6 carbon atoms or is a straight-chain or branched alkylene radical of 3 to 8 carbon atoms which is interrupted by 1 or 2 groups of the formulae —O— and —NH— or a combination thereof;

m is 1 or 2;

n is from 1 to 4;

the amino, hydroxyl and ester groups can be attached to a primary, secondary or tertiary carbon atom of the alkylene radical.

3. The process as claimed in claim 2, wherein alk is a straight-chain or branched alkylene radical of 2 to 6 carbon atoms.

4. The process of claim 1 wherein in the ester group in the amino-containing compound is a sulfato or phosphato group or is a $C_1$–$C_4$-alkanoyloxy group, a phenylsulfonyloxy group or a phenylsulfonyloxy group substituted in the benzene nucleus by substituents selected from the group consisting of carboxyl, $C_1$–$C_4$-alkyl, $C_1$–$C_4$-alkoxy and nitro.

5. The process of claim 1 wherein the compound modifying the fiber material is N-(β-sulfatoethyl)piperazine, N-(2-sulfatoethyl)piperazine sulfate, N-[β-(β'-sulfatoethoxy)ethyl]piperazine, N-(γ-sulfato-β-hydroxypropyl)piperidine, N-(γ-sulfato-β-hydroxypropyl)pyrrolidine, N-(β-sulfatoethyl)piperidine, 2-sulfato-3-hydroxy-1-aminopropane, 3-sulfato-2-hydroxy-1-aminopropane, 1-sulfato-3-hydroxy- 2-aminopropane, 3-hydroxy-1-sulfato-2-aminopropane, 2,3-disulfato-1-aminopropane or 1,3-disulfato-2-aminopropane or a derivative of these compounds with an ester group other than the sulfato group.

6. The process of claim 1 wherein the amino compound used is a compound which contains a reactive moiety capable of reacting with hydroxyl groups.

7. The process of claim 1 wherein the amino compound used contains a moiety with α-chloro-β-hydroxy substitution.

8. The process of claim 1 wherein, if the process is carried out batchwise, the modifying agent is added linearly, degressively or directly during the kiering or scouring in a concentration of from 10 to 100 g/l, at a sodium hydroxide solution concentration of from 5 to 30 g of NaOH/l.

9. The process of claim 8, wherein the modifying agent is added in a concentration of from 15 to 30 g/l.

10. The process of claim 1 wherein, if the process is carried out continuously, from 2 to 10% by weight of a modifying agent are used during the kiering or scouring at a sodium hydroxide solution concentration of from 5 to 20% by weight, based on the material to be treated.

11. The process of claim 10, wherein from 3 to 8% by weight of a modifying agent are used, based on the material to be treated.

12. The process of claim 1 wherein the modification is carried out at a temperature between 80° and 120° C.

13. The process of claim 12, wherein the modification is carried out at a temperature between 90° and 102° C.

14. A process for dyeing the aminated cotton fibers produced as a claimed in claim 1, which comprises making up the dyebaths, padding liquors, print pastes and inkier formulations without alkaline compounds and electrolyte salts.

* * * * *